United States Patent [19]

Cherrington

[11] Patent Number: 4,899,835

[45] Date of Patent: Feb. 13, 1990

[54] JET BIT WITH ONBOARD DEVIATION MEANS

[76] Inventor: Martin D. Cherrington, The Cherrington Corp., P.O. Box 254788, Sacramento, Calif. 95865

[21] Appl. No.: 348,910

[22] Filed: May 8, 1989

[51] Int. Cl.[4] ..... E21B 7/08

[52] U.S. Cl. ..... 175/74; 175/73; 175/320; 175/393

[58] Field of Search ..... 175/74, 73, 75, 320, 175/393, 424, 61, 67

[56] References Cited

U.S. PATENT DOCUMENTS

| | | | |
|---|---|---|---|
| 2,197,019 | 4/1940 | Monroe | 175/61 X |
| 2,829,864 | 4/1958 | Knapp | 175/75 X |
| 3,190,374 | 6/1965 | Caperan et al. | 175/74 |
| 3,743,034 | 7/1973 | Bradley | 175/73 X |
| 3,958,649 | 5/1976 | Bull et al. | 175/61 |
| 4,484,641 | 11/1984 | Diomukes | 175/74 X |
| 4,694,914 | 9/1987 | Obrecht | 175/74 X |
| 4,714,118 | 12/1987 | Baker et al. | 175/61 X |
| 4,834,196 | 5/1989 | Falgont, Sr. | 175/74 |
| 4,836,301 | 6/1989 | Van Dongen et al. | 175/74 X |

*Primary Examiner*—Hoang C. Dang
*Attorney, Agent, or Firm*—Vinson & Elkins

[57] ABSTRACT

A directional drill bit utilizing pressurized fluid as a means for eroding earth in a forward path of the bit and being used to drill at least a portion of an arcuate path, comprises an elongate hollow body having two sections joined one to the other by a flexible joint, a box end connection, a jet nozzle, an articulation device comprising a spring and a stop, the articulation device being responsive to changes in fluid pressure by permitting a forward portion of the bit bearing the nozzle structure to change angular position with respect to an aft portion of the bit, by the forward portion moving from a first position relative to the aft portion to a second position relative to the aft portion. The spring is positioned in a manner which defines an initial, pre-selected degree of axial alignment describing a first angle formed by the relative position of the longitudinal axis of the first section with the longitudinal axis of the second section when the elongate hollow body is in its "at rest" position, that is, when no fluid is flowing through the drill bit. The stop is positioned in a manner which defines a final, preselected degree of axial alignment describing a second angle formed by the relative position of the longitudinal axis of the first section with the longitudinal axis of the second section when the elongate hollow body is in its maximum degree of angular displacement relative to the initial, pre-selected degree of axial alignment.

27 Claims, 3 Drawing Sheets

JET BIT WITH ONBOARD DEVIATION MEANS

FIELD OF THE INVENTION

This invention relates to a directional drilling apparatus. Specifically, the apparatus is a jet drilling bit comprising an elongated hollow body having a plurality of jet nozzles at one end and including means for changing the direction of the drilling angle in azimuth and in inclination during the drilling operation. The bit comprises certain means for articulation of a forward portion of the bit relative to an aft portion of the bit which means allows the angle of drilling to be changed based upon the pressure of the fluid passing through the elongated body and exiting the nozzle structure.

BACKGROUND OF THE INVENTION

Generally, it is preferred to drill arcuate paths or tunnels beneath water courses, roadways, and other surface obstacles, especially where there is a need to forego dredging a river bed, digging a trench, or otherwise altering the obstacle. For example, when a road is encountered, the road must either be closed, the traffic diverted, or parts of the road closed and then conduit laid in section, all of which are inconvenient and interfere substantially with the use of the road. Likewise, problems arise when a conduit must span a water course. First, the trench must be dug to a depth considerably below the level at which the conduit is to be laid since the water current will cause partial filling of the trench before the conduit can be inserted. This is a very significant problem because such trenches have a generally triangular cross-section and the volume of dirt which must be removed increases with the square of the depth of the trench. Moreover, such trenching stirs the alluvium at the bottom of the water course interfering with the natural flora.

Even after a trench has ben dug in a water course, difficulties arise in placing the conduit therein. One method of placing the conduit is to float it across the span of the water course and then remove its buoyancy to sink the pipe into the trench. The difficulty with this method is that the water course must be closed to traffic, floating objects are trapped by the floating conduit, the current of the river bends the conduit, and when the conduit is sunk, it quite often misses the trench. The second method is to attach a sled or skid to the leading edge of the conduit, and drag this leading end through the trench to lay the conduit. With this method, the conduit must be coated with the substance to give it negative buoyancy, and this coating is quite expensive since the entire length of the conduit must be so coated.

Traditional methods of digging wells cannot be adapted to digging arcuate paths such as that required for implanting a pipeline or other conduit under an obstacle. Such traditional methods utilize a drill stem which enters the ground substantially normal to its surface. If these methods were utilized, the drill stem would have to undergo a 180 degree turn to span the obstacle. Such a path would result in a drill string extending vertically upwardly at the other side of the obstacle with the weight of the drill string acting against the forward motion of the drill. Since the weight of the string is used to drive the drill, such a method cannot be used when drilling the upward portion of an inverted arcuate path. Moreover, traditional well drilling methods rely on the weight of the pendant drill string to achieve a substantially vertical hole. In the past, when an angular bend in the hole was desired, it was the practice to lower a whip stock shim into the bottom of the hole which shim forced the drill off at an angle. Later methods utilized a self-powered drill which had a drill stem slightly angularly inclined with respect to the drill string. The problem with both of these methods is that the entire drill string must be removed from the hole, either to lower the whip stock or to mount the inclined drill. After the angle has been made, the entire drill string must be withdrawn again to remove either the whip stock or the inclined drill. Hence, these methods have been used primarily for drilling controlled arcuate paths and are useful for intermittent bends and/or constant radius turns.

Techniques have been developed for drilling holes along a substantially linear horizontal path for placing telephone lines under streets and the like. However, these methods employ drills which proceed in a straight line, and to achieve an arcuate path, a pothole must be dug and the drill manually redirected. Such a method is often acceptable in traversing an obstruction such as a road, particularly a road which is constructed such that it has high shoulders on both sides, but is impractical for traversing a water course because of the expense involved in digging the required potholes.

Each of the aforementioned methods utilizes a traditional drill comprising a rotary bit which bit mechanically erodes the earth with which it comes into contact. The eroded earth is then carried away by a continuously moving stream of fluid passing from the surface through the bore or drill stem to the rotating bit, through the bit and back through the space between the drill string and the hole wall, and then back to the surface thus carrying away the debris. These methods are simplified through utilization of a jet bit wherein the jet bit utilizes a plurality of jet nozzles to direct a pressurized fluid spray against the earth both to erode the earth and to supply the fluid with which to transport and otherwise facilitate removal of the debris produced by action of the jet spray.

SUMMARY OF THE INVENTION

The present invention comprises a jet drilling bit having means for variable articulation of the bit through adjustment of the drilling angle in azimuth of the bit as the bit moves forwardly during the drilling operation. The variable articulation means is responsive to internal fluid pressure such that as the fluid pressure is increased, the articulation means permits a forward portion of the jet bit bearing the nozzle structure to change its position with respect to an aft portion of the jet bit. The maximum change in angle preferably is three degrees, but may be as much as a total of ten degrees.

The jet bit comprises an elongated hollow body divided into a first section and into a second section which sections are connected by a flexible joint, such as bellows joint. The proximal end of the jet bit is internally threaded to provide a box connection used to join the bit to a fluid transport means such as a tubular member or such as an appropriate drill string. The distal end of the jet bit carries a nozzle plate having a plurality of wear resistant jet nozzle structures. The bit further comprises a spring means and a stop means, both positioned intermediately of the proximal end and of the distal end of the bit. The spring means, preferably an elongated bar, is attached at its proximal end to the internal sidewall of the first section of the elongated hollow body of the bit and at its distal end to the internal sidewall of the second section of the elongated hollow body of the bit. The stop means positioned oppositely of the spring means is attached at its proximal end to the internal sidewall of the first section of the elongated hollow body of the bit and at its distal end to the internal sidewall of the second section of the elongated hollow body of the bit. The cooperation of the spring means with the stop means allows a forward portion of the jet bit to change position with respect to an aft portion of the jet bit based upon variations in fluid pressure within the jet bit. This change in position of the jet bit, in turn, causes the drilling angle to change.

The primary object of the invention is to provide a simple and efficient directional drilling tool comprising a jet drilling bit.

Another object of this invention is to provide a directional drilling tool comprising a directional drilling bit in which fluid, rather than mechanical erosion means, is employed, and which bit comprises an elongated fluid conveyance means joined with a nozzle plate bearing a plurality of jet nozzle structures therein.

Another object of the invention is to provide a drill bit including provisions for changing direction or angle of drilling of a bore hole, as in the drilling of an arcuate portion of a bore hole, through manipulation of a portion of the drilling bit so as to change the drilling angle in azimuth of the bit.

Another object of the invention is to provide a jet drilling bit including provisions for changing the direction or angle of drilling of a bore hole, as in the drilling of an arcuate bore hole, through articulation of the drilling bit accomplished by increasing and decreasing the internal fluid pressure within the drilling bit.

Another object of this invention is to provide a jet drilling bit including non-motorized provisions for changing the direction or angle of drilling of a bore hole, as in the drilling of an arcuate bore hole, through articulation of the drilling bit accomplished through manipulation at the surface of the earth of the internal fluid pressure within the drilling bit.

These general objectives, as well as these specific objectives of the invention, will be understood by reference to the description taken in conjunction with the attached drawings.

DETAILED DESCRIPTION OF THE INVENTION

Figure 1:
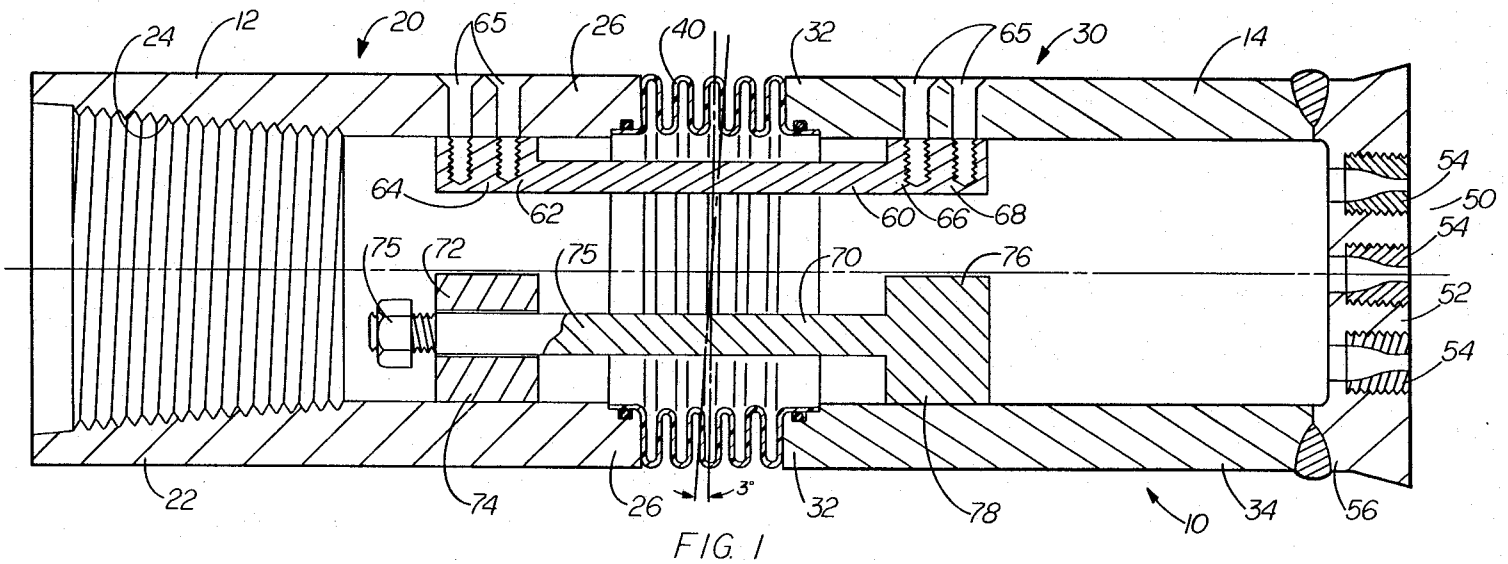
FIG. 1 is a cross-sectional view of the first embodiment of the drilling bit of this invention, showing the relationship of the components of the bit prior to articulation as when the bit of this embodiment is in its "at rest" condition with substantially straight axial alignment.

The jet drilling bit of the present invention comprises an elongated hollow body structure 10 divided into at least a first section 20 and a second section 30 which sections are connected by flexible joint 40, preferably a bellows joint. The proximal end 12 of the jet bit, which end is also proximal end 22 of first section 20, is provided with a connection means 24 with which to join the bit with a fluid transport means such as a tubular member or such as an appropriate drill string. The distal end 26 of the first section 20 is sealingly connected with one end of flexible joint 40. The other end of flexible joint 40 is sealingly attached with proximal end 32 of the second section 30. The distal end 34 of the second section 30 which end, in the preferred embodiment, also is the distal end 14 of the jet bit, is sealingly connected with a nozzle structure 50 which structure bears a fluid rejection port. For example, the nozzle structure 50 comprises a nozzle plate 52 bearing at least one jet nozzle and preferably a plurality of jet nozzles 54.

In the preferred embodiment, each jet nozzle 54 is removably secured to the nozzle plate 52, for example, by threaded connections. Further, the nozzle plate 52 preferably has a flange 56 which is positioned for securement with distal end 34 of the second section 30 and/or with the distal end 14 of the elongated hollow body structure 10 of the jet bit. In the preferred embodiment, the combination of flange 56 and nozzle plate 52 comprises a monolithic nozzle structure 50 with flange 56 sealingly joined with the distal end 14 of the elongated hollow body structure 10 through bonding. In the alternative, other methods of sealingly connecting the nozzle structure with the jet bit body may be employed such as a threaded connection employing seals where necessary. Further, the nozzle structure 50 may be constructed simply as a nozzle plate 52 such that nozzle plate 52 may be attached, for example, through bonding or through a threaded securement means, within a flange-like portion carried on the distal end 14 of the jet bit.

In a first embodiment, the jet bit further comprises a spring means 60, preferably an elongated spring bar, and a stop means 70, both of which preferably are located within the elongated hollow body structure 10. The spring bar 60 is attached at its proximal end 62 to a portion of the sidewall of the first section 20 and at its distal end 66 to a portion of the sidewall of the second section 30. Accordingly, the intermediate portion of spring bar 60 spans flexible joint 40 but does not fully shield the flexible joint, for example, from fluid passing through the hollow body 10 of the jet bit. Spring bar 60 is secured to the sidewall of the hollow body 10 by mechanical fasteners 65 such as screws or bolts, or by bonding. The spring bar has at its proximal end 62 a thickened flange portion 64 and at its distal end portion 66 a similar thickened flange portion 68, each thickened flange portion 64 and 68 serving to receive a portion of a separate mechanical fastener. In the absence of mechanical fasteners, the flange portions are used to secure the spring bar 60 to the sidewall of hollow body 10, for example, by bonding.

Situated on the side of the hollow body structure 10, oppositely from the spring bar 60, is stop means 70. The stop means 70 is attached at its proximal end 72 to a portion of the sidewall of the first section 20 and at its distal end 76 to a portion of the sidewall of the second section 30. Accordingly, the intermediate portion of stop means 70, like the intermediate portion of spring means 60, spans flexible joint 40 but does not fully shield the flexible joint, for example, from fluid passing through the hollow body 10 of the jet bit. Stop means 70 is secured to the sidewall of hollow body 10 by mechanical fasteners such as screws or bolts, or by bonding. The stop means 70, like the spring means 60, has at its proximal end 72 a thickened flange portion 74 and at its distal end 76 a similar thickened flange portion 78, each thickened flange portion 74 and 78 serving to receive a portion of a separate mechanical fastener. In the absence of mechanical fasteners, the flange portions are used to secure the stop means 70 to the sidewall of hollow body 10, for example, by bonding.

Stop means 70 is adjustable to allow for various drilling angles. For example, the intermediate portion of stop means 70 is an elongated slide member 73 which extends outwardly from flange portion 78 and rearwardly toward the proximal end 12 of hollow body 10. Slide member 73 carries adjustable barrier 75 on its distal end. Slide member 73 extends through an appropriate aperture 77 or bore in flange portion 74, with adjustable barrier 75 being positioned rearwardly of flange portion 74 and between flange portion 74 and proximal end 12 of hollow body 10. The adjustable barrier 75 comprises a structural element which disallows certain forward movement of the elongated member 73 through bore 77 during flexing of the hollow body 10, and when adjustable barrier 75 contacts that portion of flange 72 which surrounds aperture 77. Adjustable barrier 75 is, for example, a nut threadingly engaged with and carried on the distal end portion of elongated member 73.

As an alternative stop means, which is not illustrated, elongated side member 73 extends outwardly from flange portion 74, and forwardly toward the nozzle plate 52. Flange portion 78 carries an aperture or bore through which a portion of elongated slide member 73 passes and cooperates with an adjustable barrier, such as barrier 75, which adjustable barrier is positioned between flange portion 74 and flange portion 78. This adjustable barrier, like that of barrier 75, comprises a structural element which disallows forward movement of the elongated member 73 through the bore and flange portion 78, and like that of barrier 75, is, for example, a nut threadingly engaged with and carried on a portion of the elongated member 73 which portion is positioned between flange portion 74 and flange portion 78.

When the drill bit of this first embodiment is in the "at rest" position, that is, with no fluid flowing through hollow body 10, a straight axial alignment is maintained; the longitudinal axis of the first section 20 is aligned with the longitudinal axis of the second section 30. In this first embodiment, when no or low fluid pressure is applied, a substantially straight axial alignment is achieved; when varying moderate pressure is applied, varying axial alignment is achieved; and, when relatively high fluid pressure is applied, a high angular axis is is changed based upon the amount of fluid pressure applied within the jet bit.

Figure 2:
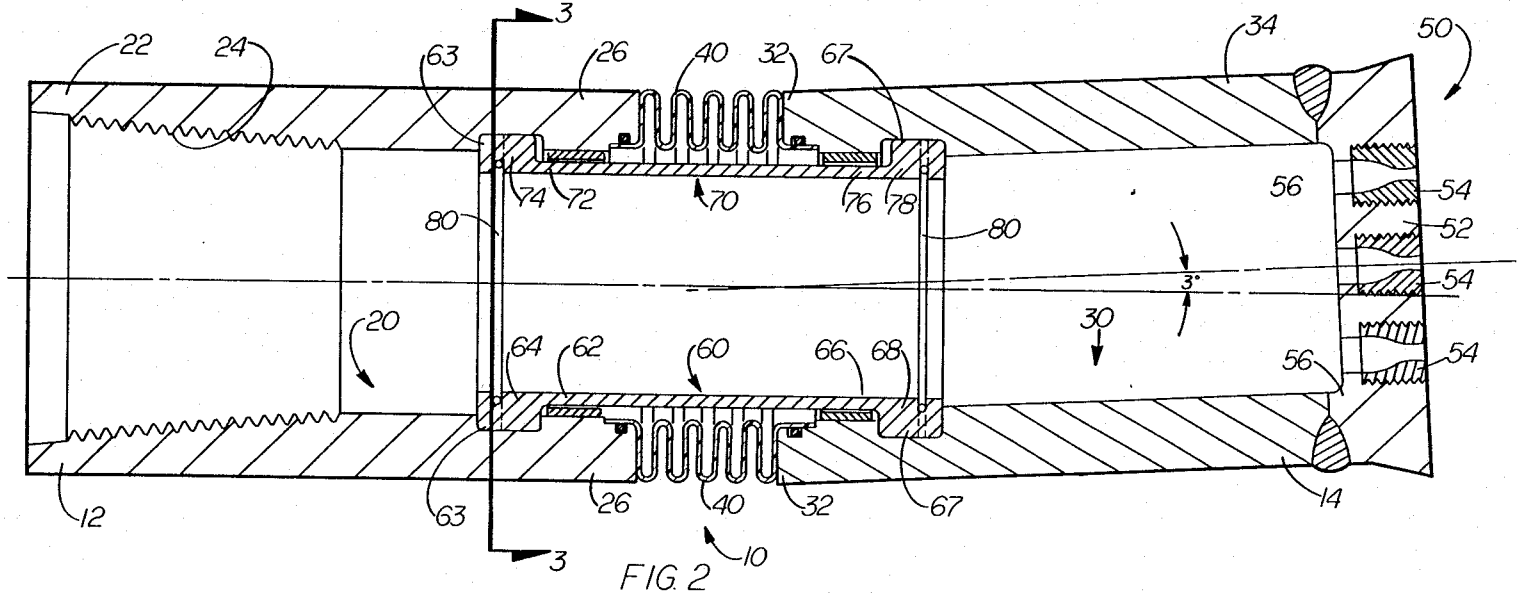
FIG. 2 is a cross-sectional view of a second embodiment of the drill bit of this invention showing a streamlined interior and showing the relationship of the components of the bit prior to articulation as when the bit of this embodiment is in its "at rest" condition with highly angular axial positioning.
Figure 3:
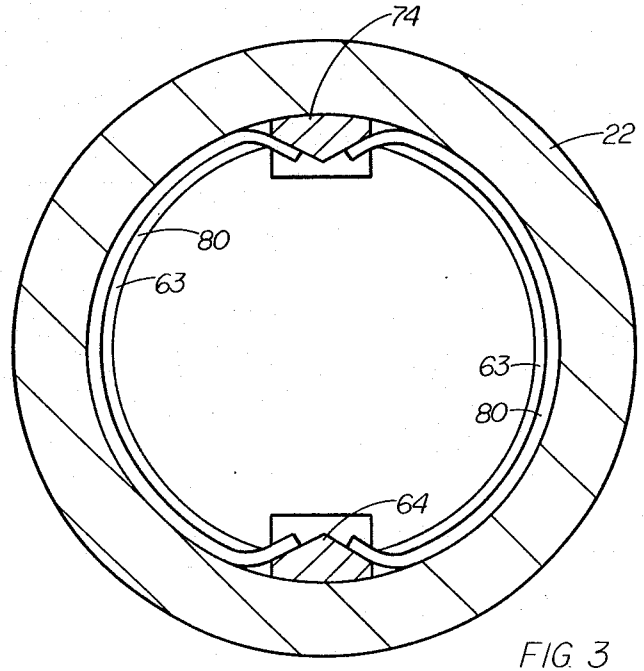
FIG. 3 is a transverse cross-sectional view taken along line 3—3 of FIG. 2, showing a portion of a spring member and a portion of a stop member positioned within an annular channel member carried in the interior sidewall of the first section of the hollow body of the jet bit, and showing a plurality of C-shaped spring clips securing both the spring means and the stop means in their respective positions.

In a second embodiment, spring means 60, for example, a spring bar, carries a thickened flange-like portion 64 at proximal end 62, and a thickened flange-like portion 68 at distal end 66. Flange-like portion 64 cooperates with and is positioned within a portion of an annular channel 63 provided in the sidewall of first section 20 which first section 20 is a hollow annular member. Likewise, flange-like portion 68 cooperates with and is positioned within a portion of an annular channel 67, provided in the sidewall of second section 30 which second section 30 is a hollow annular member. Moreover, flange-like portion 64 and flange-like portion 68 are positioned securely within channel 63 and within channel 67, respectively, so as not to allow longitudinal translation forwardly and backwardly of either of the flange-like portions 64 and 68 of spring means 60. As shown in FIG. 2, spring means 60 is positioned so as to maintain a high angular axis of the jet bit. Flange-like portion 68 is positioned deeper within groove 67 than flange-like portion 64 is positioned within groove 63.

In addition, the second embodiment employs a stop means 70 positioned on a side of the hollow body structure 10, oppositely from the spring means 60. Stop means 70 carries a thickened flange-like portion 74 at its proximal end 72 and a thickened flange-like portion 78 at its distal end 76. Flange-like portion 74 cooperates with and is positioned within a portion of annular channel 63; likewise, flange-like portion 78 cooperates with and is positioned within a portion of annular channel 67. However, unlike flange-like portions 64 and 68, flange-like portions 74 and 78 are positioned loosely within channel 63 and channel 67, respectively, so as to allow a calculated degree of longitudinal translation forwardly and backwardly of each of flange-like portions 74 and 78 of stop member 70. In this second embodiment, both the spring means 60 and stop means 70 are held in position by spring clips 80, such as a plurality of C-shaped spring clips, two of which cooperate to achieve a locking function.

When the jet drill bit of the second embodiment is in the "at rest" position, that is, with no fluid flowing through hollow body 10, a high angular axis is maintained. Thus, the longitudinal axis of the first section 20 and the longitudinal axis of the second section 30 are not coaxially aligned but, rather, are positioned one relative to the other so as to form an oblique angle. In this second embodiment, when no or low fluid pressure is applied, a high angular axis is maintained; when varying moderate pressure is applied, varying axial alignment is achieved; and, when relatively high fluid pressure is applied, substantially straight axial alignment is maintained. Accordingly, the direction or angle of drilling is changed based upon the amount of fluid pressure applied. The stiffness of spring means 60, also, dictates the degree of axial alignment with regard to the fluid pressure.

The second embodiment can be made to function in a manner similar to the first embodiment, as the first embodiment is illustrated in the drawings, by arranging spring means 60 such that flange-like portion 64 and flange-like portion 68, especially portion 68, are positioned within channel 63 and within channel 67, respectively, such that a high angular displacement is not achieved in the "at rest" position. With calculated positioning of flange-like portion 64 and flange-like portion 68, a substantially axial alignment of the longitudinal axis of the first portion and the longitudinal axis of the second portion is achieved when the bit is in the "at rest" position. The direction and angle of drilling will then change based upon the amount of fluid pressure applied within the jet bit.

The first embodiment can be made to function in a manner similar to the second embodiment, as the second embodiment is illustrated in the drawings, by arranging spring means 60 such that the longitudinal axis of first section 20 and the longitudinal axis of second section 30 form an oblique angle when the jet bit is in the "at rest" position, that is, when no fluid flow through hollow body 10. With this calculated placement, when no or low fluid pressure is applied, a high angular axis is maintained; when varying moderate pressure is applied, varying axial alignment is achieved; and, when relatively high fluid pressure is applied, substantially straight axial alignment is achieved. Accordingly, the direction or angle of drilling is changed based upon the amount of fluid pressure applied within the jet bit. The maximum change in angle preferably is three degrees, but may be as much as a total of ten degrees.

The jet bit of this invention is fabricated, for example, of wear resistent metal, of wear resistent composite material, or from a combination of both of these materials. Depending upon which material is chosen for fabrication, the components may be joined where appropriate by "bonding" (which term includes, for example, adhesive bonding, chemical bonding, and welding) or by mechanical fastening means. In addition, the preferred cross-sectional shape is annular. Further, both the spring means and the stop means may be positioned exteriorly on the hollow body portion 10, but preferably, are positioned within the hollow body portion 10. In any event, the major components of the jet bit of this invention function in concert to achieve directional drilling with angular placement of the jet bit occurring as a function of the fluid pressure of the fluid passing through the hollow body 10 of the jet drill bit. Thus, variations in fluid pressure allow articulation of the drill bit to change position of the arcuate path when deemed necessary.

I claim:

1. A directional drill bit utilizing pressurized fluid as a means for eroding earth in a forward path of said bit, said bit comprising:

an elongate hollow body having a first proximal end and a first distal end, and having at least a rigid first section and at least a rigid second section, said first section and said second section being connected one to the other by a flexible joint positioned intermediately of said first section and said second section, with the combination of said first section, said flexible joint and said second section providing a conduit having leak-free annular sidewalls, said combination thereby defining said elongate hollow body;

a connecting means formed by said first proximal end for joining said elongated hollow body with an appropriate fluid conveyance means used to transport said pressurized fluid;

a nozzle means borne by said first distal end, said nozzle means comprising a nozzle plate having at least one jet nozzle attached to and carried by said nozzle plate:

an articulation means comprising a spring means and a stop means, said articulation means being responsive to changes in fluid pressure and permitting a forward portion of said bit bearing said nozzle structure to change angular position with respect to an aft portion of the bit, by said forward portion moving from a first position relative to said aft portion to a second position relative to said aft portion;

said spring means having a second proximal end and a second distal end, said second proximal end being secured to said first section and said second distal end being secured to said second section, said spring means being positioned in a manner which defines an initial, preselected degree of axial alignment with said degree of initial, pre-selected axial alignment being described by a first angle formed by the relative position of the longitudinal axis of said first section with the longitudinal axis of said second section when said elongate hollow body is in its "at rest" position; and said stop means being positioned oppositely from said spring means and having a third proximal end and a third distal end, said third proximal end being operatively connected to said first section and said third distal end being operatively connected to said second section, said stop means being positioned in a manner which defines a final, pre-selected degree of axial alignment with said degree of final, preselected axial alignment being described by a second angle formed by the relative position of the longitudinal axis of said first section with the longitudinal axis of said second section when said elongate hollow body is in its maximum degree of angular displacement relative to said initial, pre-selected degree of axial alignment.

2. The directional drill bit of claim 1 wherein said connecting means is a threaded connection.

3. The directional drill bit of claim 1 wherein said nozzle plate bears a plurality of jet nozzles therein.

4. The directional drill bit of claim 1 wherein said nozzle plate bears an upstanding outwardly protruding flange portion which flange portion mates with said distal end portion of said elongate hollow body.

5. The directional drill bit of claim 4 wherein said flange portion is secured mechanically and in sealing relationship with said proximal end of said elongate hollow body.

6. The directional drill bit of claim 4 wherein said flange portion is secured in sealing relationship with said proximal end of said elongate hollow body by bonding.

7. The directional drill bit of claim 1 wherein said flexible joint is an element bearing a plurality of convolutions.

8. The directional drill bit of claim 1 wherein said flexible joint is a bellows joint.

9. The directional drill bit of claim 1 wherein said spring means comprises an elongate spring bar having a first thickened end portion at said second proximal end and a second thickened end portion at said second distal end, which two thickened end portions therebetween define an intermediate portion of said spring bar and serve to position said intermediate portion of said elongate spring bar in spaced relationship with said portion of said first section and said portion of said second section.

10. The directional drill bit of claim 9 wherein said spring means is secured both to said first section and to said second section by mechanical fastening means.

11. The directional drill bit of claim 9 wherein said spring means is secured to said first section and to said second section by bonding.

12. The directional drill bit of claim 1 wherein said third proximal end and said third distal end both have thickened end portions and wherein said stop means comprises an elongate element positioned longitudinally of said elongate hollow body and extending outwardly and away from one of said third proximal and said third distal ends and toward the other of said third proximal and said third distal ends.

13. The directional drill bit of claim 12 wherein said elongate element is fixedly attached to said thickened end portion of said third distal end, extends through an aperture carried by said thickened end portion of said third proximal end, and bears an adjustable means on that end portion of said elongate element extending rearwardly, out of said aperture and toward the proximal end of said hollow body.

14. The directional drill bit of claim 13 wherein said adjustable means comprises a nut cooperating with a threaded portion of said elongate element.

15. The directional drill bit of claim 12 wherein said elongate element is fixedly attached to said thickened end portion of said third proximal end, extends through aperture carried by said thickened end portion of said third distal end, and bears an adjustable means on a portion of said elongate element extending forwardly, through said aperture and toward the distal end of said hollow body with said adjustable means being carried on a portion of said elongate element positioned intermediately of said thickened end portion of said third proximal end and of said thickened end portion of said third distal end.

16. The directional drill bit of claim 15 wherein said adjustable means comprises a nut cooperating with the threaded portion of said elongate element.

17. The directional drill bit of claim 1 wherein said longitudinal axis of said first section and said longitudinal axis of said second section are initially coaxially aligned when said elongate hollow body is in its "at rest" position.

18. The directional drill bit of claim 1 wherein said longitudinal axis of said first section and said longitudinalaxis of said second section are positioned initially in parallel, one with the other, when said elongate hollow body is in its "at rest" position.

19. The directional drill bit of claim 1 wherein said longitudinal axis of said first section and said longitudinal axis of said second section intersect initially to define an oblique angle when said elongate hollow body is in its "at rest" position.

20. A directional drill bit utilizing pressurized fluid to drill at least a portion of an arcuate path from a first position to a second position; said bit comprising:

an elongate hollow body having a first proximal end for entry of said pressurized fluid and a first distal end for exit of said pressurized fluid, said elongate hollow body having at least a rigid first section and a rigid second section, said first section and said second section being connected one to the other by a bellows joint positioned intermediately of said first section and said second section, with the combination of said first section, said bellows joint and said second section providing a conduit having leak-free sidewalls, said combination thereby defining said elongate hollow body;

a connecting means borne by said first proximal end for joining said elongate hollow body with an appropriate fluid conveyance means used to transport said pressurized fluid;

a fluid ejection port borne by said first distal end, said ejection port comprising a nozzle plate having a plurality of jet nozzles attached to and carried by said nozzle plate;

an articulation means comprising a spring means and a stop means, said articulation means being responsive to changes in fluid pressure and permitting a forward portion of said bit bearing said nozzle structure to change angular position with respect to an aft portion of the bit, by said forward portion moving from a first position relative to said aft portion to a second position relative to said aft portion;

said spring means having a second proximal end and a second distal end, said spring means comprising a spring bar having a first thickened end portion at said second proximal end and having a second thickened end portion at said second distal end, which two thickened end portions define a thinner intermediate portion of said spring bar therebetween, said second thickened end portion being secured to a portion of said first section and said second thickened end portion being secured to a portion of said second section, said spring means being positioned to define an initial pre-selected degree of axial alignment with said degree of initial, pre-selected axial alignment being described by a first angle formed by the relative position of the longitudinal axis of said first section with the longitudinal axis of said second section when said elongate hollow body is in its "at rest" position; and said stop means being positioned oppositely from said spring means and having a third proximal end and a third distal end, said third proximal end being operatively connected to said first section and said third distal end being operatively connected to said second section, said third proximal end and said third distal end each having thickened end portions, said stop means further having an elongate element positioned longitudinally of said elongate hollow body and extending outwardly and away from one of said third proximal and said third distal ends and toward the other of said third proximal and said third distal ends with the extended portion of said elongate element bearing an adjustable barrier, said adjustable barrier further cooperating with said other of said third proximal end and said third distal end, said stop means being positioned in a manner which defines a final, pre-selected degree of axial alignment with said degree of final, preselected axial alignment being described by a second angle formed by the relative position of the longitudinal axis of said second section when said elongate hollow body is in its maximum degree of angular displacement relative to said initial, preselected degree of axial alignment.

21. The directional drill bit of claim 20 wherein said longitudinal axis of said first section and said longitudinal axis of said second section are co-axially aligned when said elongate hollow body is in its "at rest" position.

22. The directional drill bit of claim 20 wherein said longitudinal axis of said first section and said longitudinal axis of said second section are positioned initially in parallel, one with the other, when said elongate hollow body is in its "at rest" position.

23. The directional drill bit of claim 20 wherein said longitudinal axis of said first section and said longitudinal axis of said second section intersect initially to define an oblique angle when said elongate hollow body is in its "at rest" position.

24. A directional drill bit utilizing pressurized fluid to drill at least a portion of an arcuate path from a first position to a second position; said bit comprising:

an elongate hollow body having a first proximal end for entry of said pressurized fluid and a first distal end for exit of said pressurized fluid, said elongate hollow body having at least a rigid first section and a rigid second section, said first section including a first annular groove and said second section including a second annular grove, said first section and said second section being connected one to the other by a bellows joint positioned intermediately of said first section and said second section, with the combination of said first section, said bellows join and said second section providing a conduit having leak-free sidewalls, said combination thereby defining said elongate hollow body;

a connecting means borne by said first proximal end for joining said elongate hollow body with an appropriate fluid conveyance means used to transport said pressurized fluid;

a fluid ejection port borne by said first distal end, said ejection port comprising a nozzle plate having a plurality of jet nozzles attached to and carried by said nozzle plate;

an articulation means comprising a spring means and a stop means, said articulation means being responsive to changes in fluid pressure and permitting a forward portion of said bit bearing said nozzle structure to change angular position with respect to an aft portion of the bit, by said forward portion moving from a first position relative to said aft portion to a second position relative to said aft portion;

said spring means having a second proximal end and a second distal end, said spring means comprising a spring bar having a first flange at said third proximal end and a second flange at said third distal end, said first flange and said second flange defining an intermediate portion of said spring bar therebetween, said first flange being fixedly secured in said first annular groove and said second flange being fixedly secured in said second annular groove, such spring means being positioned to define an initial pre-selected degree of axial alignment with said degree of initial, pre-selected axial alignment being described by first angle formed by the relative position of the longitudinal axis of said first section with the longitudinal axis of said second section when said elongate hollow body is in its "at rest" position;

said stop means positioned oppositely from said spring means and having a third proximal end and a third distal end and having a third flange at said third proximal end and a fourth flange at said third distal end, said third flange and said fourth flange defining an intermediate portion of said stop means therebetween, said third flange being movably positioned in said first annular groove and said fourth flange being movably positioned in said second annular groove, said stop means being positioned in a manner which defines a final, pre-selected degree of axial alignment with said degree of final pre-selected axial alignment being described by a second angle formed by the relative position of the longitudinal axis of said second section when said elongate hollow body is in its maximum degree of angular displacement relative to said initial, pre-selected degree of axial alignment; and a first securement means positioned between said first flange and said third flange and a second securement means positioned between said second flange and said fourth flange, said first securement means and said second securement means cooperating to aid in fixedly securing both said first flange in said first groove and said second flange in said second groove, and to movably position both said third flange in said first groove and said second flange in said second groove.

25. The directional drill bit of claim 24 wherein said longitudinal axis of said first section and said longitudinal axis of said second section are initially coaxially aligned when said elongate hollow body is in its "at rest" position.

26. The directional drill bit of claim 24 wherein said longitudinal axis of said first section and said longitudinal axis of said second position are positioned initially in parallel, one with the other, when said elongate hollow body is in its "at rest" position.

27. The directional drill bit of claim 24 wherein said longitudinal axis of said first section and said longitudinal axis of said second section intersect initially to define an oblique angle when said elongate hollow body is in its "at rest" position.

* * * * *